United States Patent [19]

Leon

[11] 4,338,887

[45] Jul. 13, 1982

[54] LOW PROFILE FLUID BED HEATER OR VAPORIZER

[75] Inventor: Albert M. Leon, Mamaroneck, N.Y.

[73] Assignee: Dorr-Oliver Incorporated, Stamford, Conn.

[21] Appl. No.: 181,900

[22] Filed: Aug. 27, 1980

Related U.S. Application Data

[63] Continuation-in-part of Ser. No. 79,569, Sep. 27, 1979, abandoned.

[51] Int. Cl.[3] ..... B09B 3/00

[52] U.S. Cl. ..... 122/4 D; 110/245; 110/263; 110/347; 122/195; 165/104.16; 431/7; 431/170

[58] Field of Search ..... 110/263, 347, 245; 122/4 D, 195; 431/7, 170; 165/104.16

[56] References Cited

U.S. PATENT DOCUMENTS

| | | | |
|---|---|---|---|
| 2,610,842 | 9/1952 | Schoenmakers et al. | 122/4 D |
| 3,565,022 | 2/1971 | Bishop | 110/245 |
| 3,648,666 | 3/1972 | Foldes et al. | 122/4 D |
| 3,859,963 | 1/1975 | Roberts et al. | 122/4 D |
| 3,893,426 | 7/1975 | Bryers | 122/4 D |
| 4,240,377 | 12/1980 | Johnson | 110/263 |
| 4,267,801 | 5/1981 | Robinson | 431/170 X |
| 4,273,073 | 6/1981 | Robinson | 122/4 D |
| 4,301,749 | 11/1981 | Urquhart | 431/7 X |
| 4,306,854 | 12/1981 | Dawson | 431/7 X |

*Primary Examiner*—John J. Camby

*Attorney, Agent, or Firm*—Harold M. Snyder; Burtsell J. Kearns

[57] ABSTRACT

A fluid bed heater or vaporizer unit has a generally cylindrical configuration with its major axis horizontally disposed. A mixture of coal and limestone is fed into the elongated fluidized bed within the unit for combustion; the limestone being present to minimize sulfur emissions due to the sulfur present in the coal. The wall of the unit in the region of the freeboard is lined with horizontally disposed heat exchange tubing. The delivery of air to the fluidized bed is regulated so as to establish a combustion zone of high turbulence and one or more heat transfer zones of lower turbulence. A plurality of heat exchange tubes are located in the heat transfer zone or zones and within the expanded bed level of the fluidized bed but above the region occupied by the slumped bed. Economizer heat exchange coils may be located in the passageway for exhaust gases.

22 Claims, 8 Drawing Figures

FIG. 2
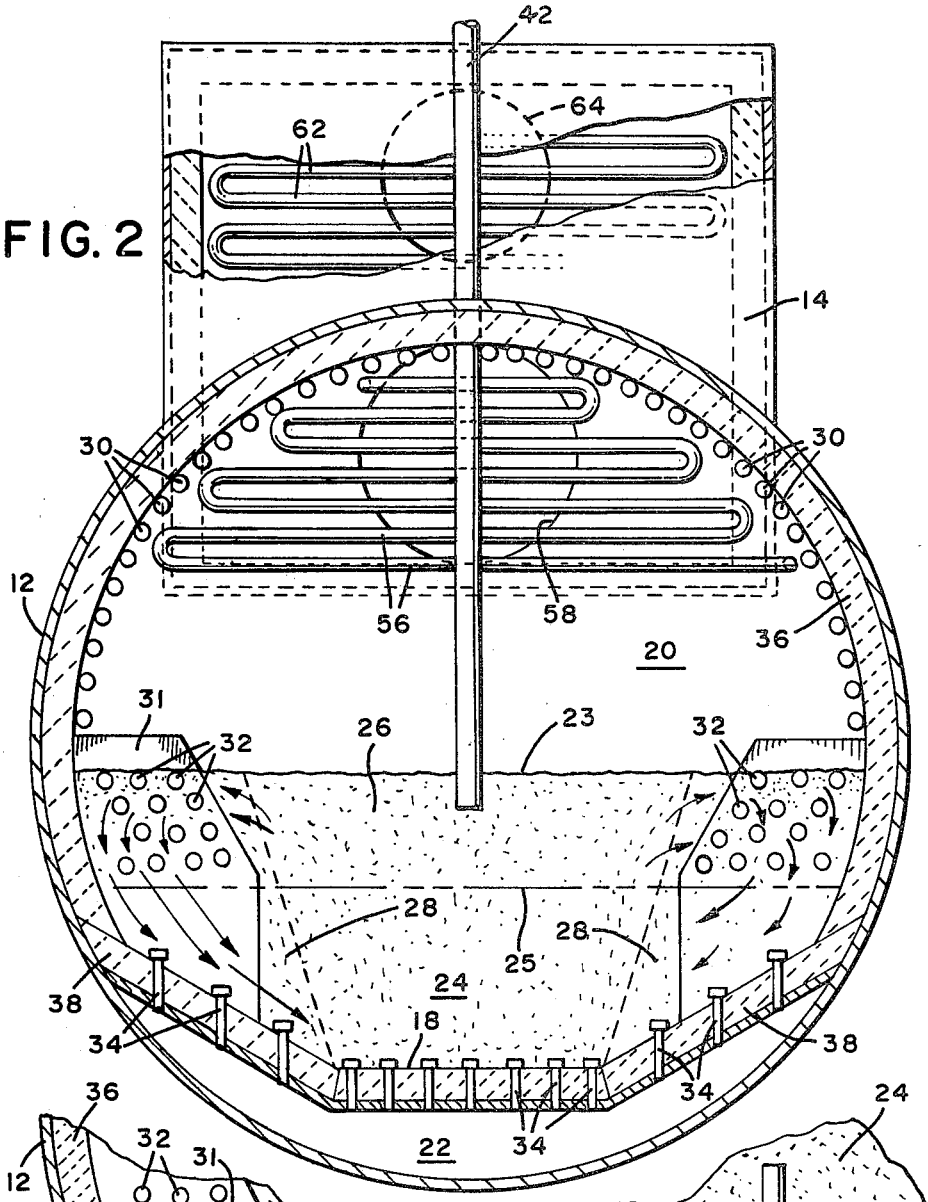
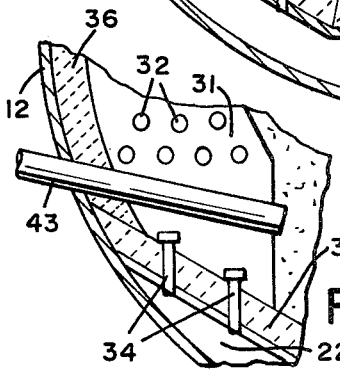
FIG. 2a
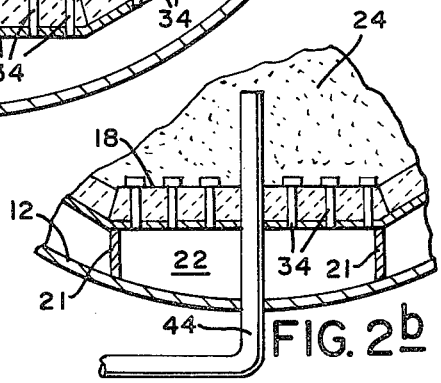
FIG. 2b

LOW PROFILE FLUID BED HEATER OR VAPORIZER

This application is a continuation-in-part of application Ser. No. 79,569, filed Sept. 27, 1979.

This invention is directed to a novel structure for a fluid bed heater or vaporizer unit for the steam flooding process of oil recovery, for the Frasch process and for other industrial applications.

The substitution of coal for oil as a fuel has been accorded increased attention in recent times. Much consideration has been given to the conversion of utility plants from the oil-burning to the coal-burning type. These utility plants are very large and conversion of such plants to coal combustion will aid greatly in the effort to conserve oil resources.

However, there are industrial processes that require heaters or boilers of only moderate size which might advantageously use coal or other alternate fuels in place of oil. Such a case is the steam flooding of oil wells, in which steam is injected into the oil-bearing rock layer and the oil and water mixture forced upward through a second well for capture and recovery of the oil. Another such case is the Frasch process in which hot water is forced into subterranean sulfur deposits, the sulfur melted by the hot water and the molten sulfur raised to the surface and the sulfur recovered. It will be understood that other processes requiring heat, for example, drying or other physical treatments or chemical reactions, may utilize such heaters or vaporizers of moderate size.

In some cases, it is desirable that the heater or vaporizer unit be shop assembled and transportable by rail or truck so that it can be moved from site to site where needed. Transportable units must necessarily be of a compact design having a low profile due to the limited capacity of the vehicles used for transport and the clearance required for obstructions such as tunnels and bridges over highways and railroads.

In accordance with this invention, a novel fluid bed heater or vaporizer unit has been provided having a low profile and which is readily transportable.

It is an object of this invention to provide a fluid bed heater or vaporizer in which fuel is burned efficiently in a unit of compact size.

It is another object of this invention to provide a fluid bed heater or vaporizer in which solid particulate fuel is consumed while the emission of sulfur compounds into the atmosphere is minimized.

Still another object of this invention is to provide an improved arrangement of heat exchange tubes in a fluid bed heater or vaporizer.

Figure 1:
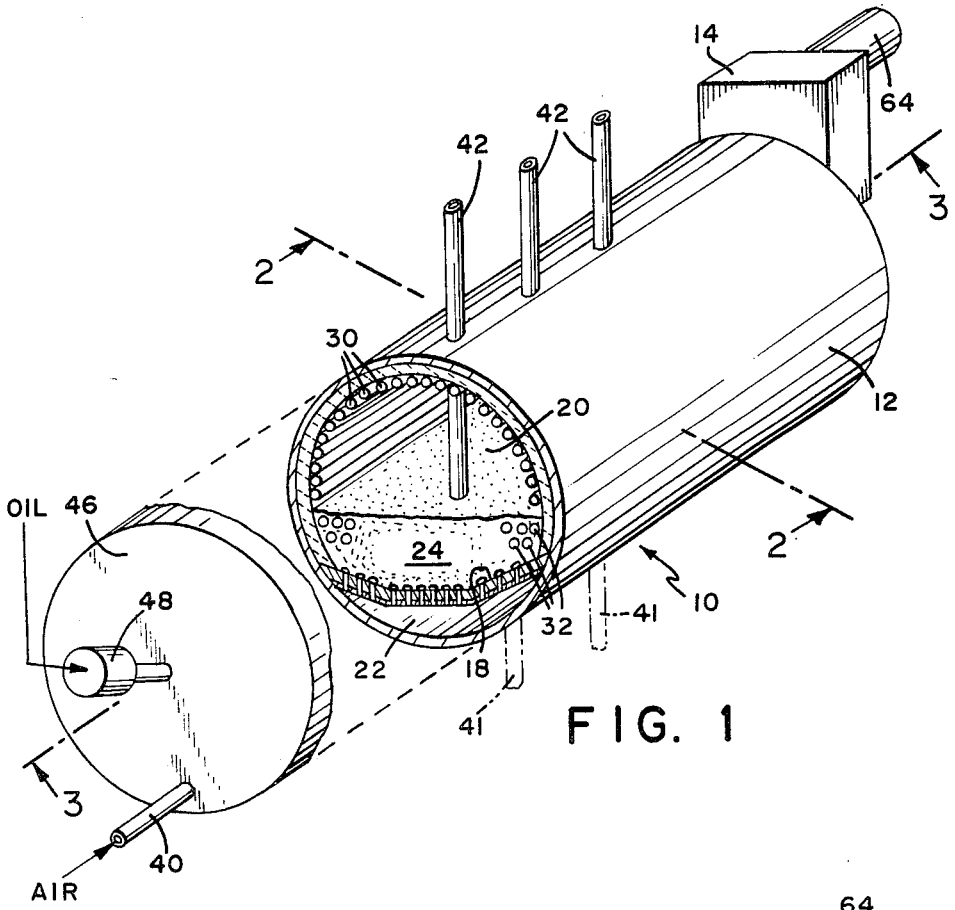
Figure 3:
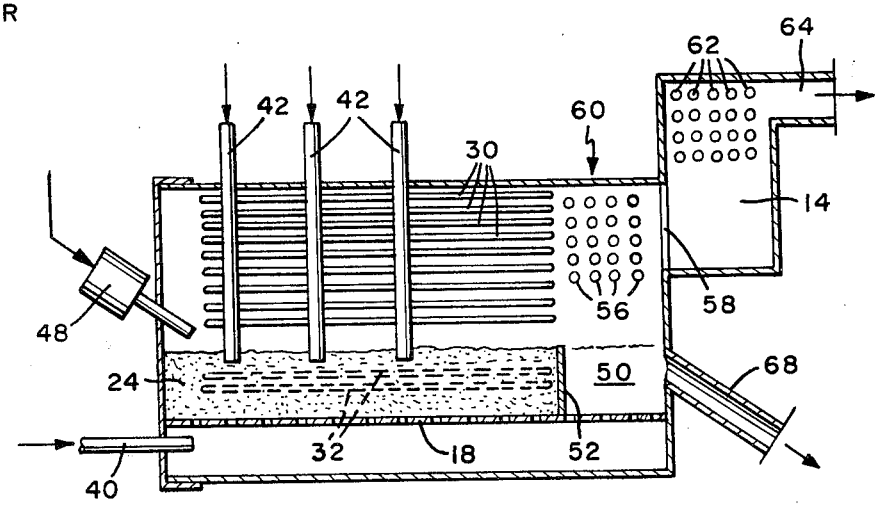
Figure 4:
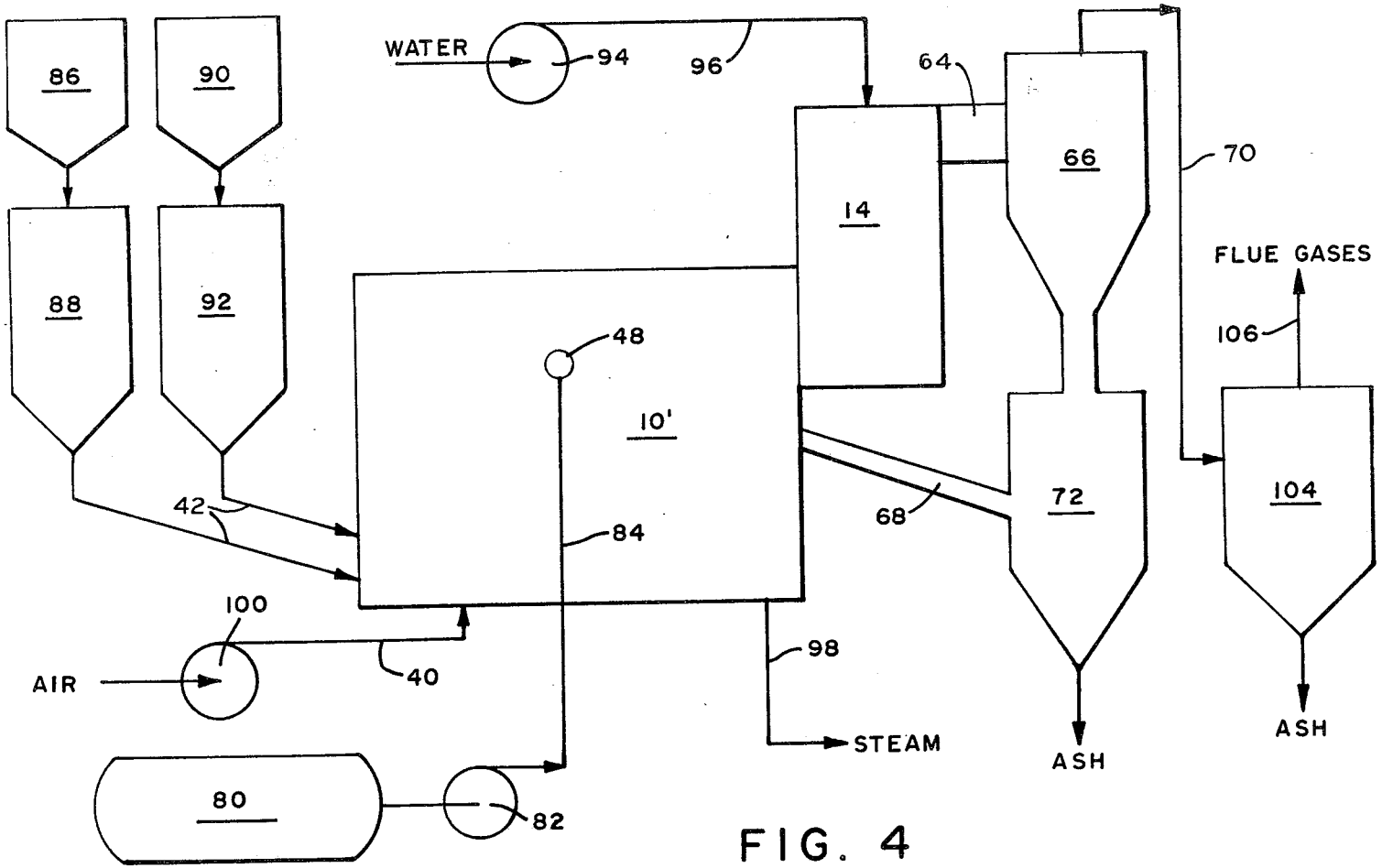
Figure 5:
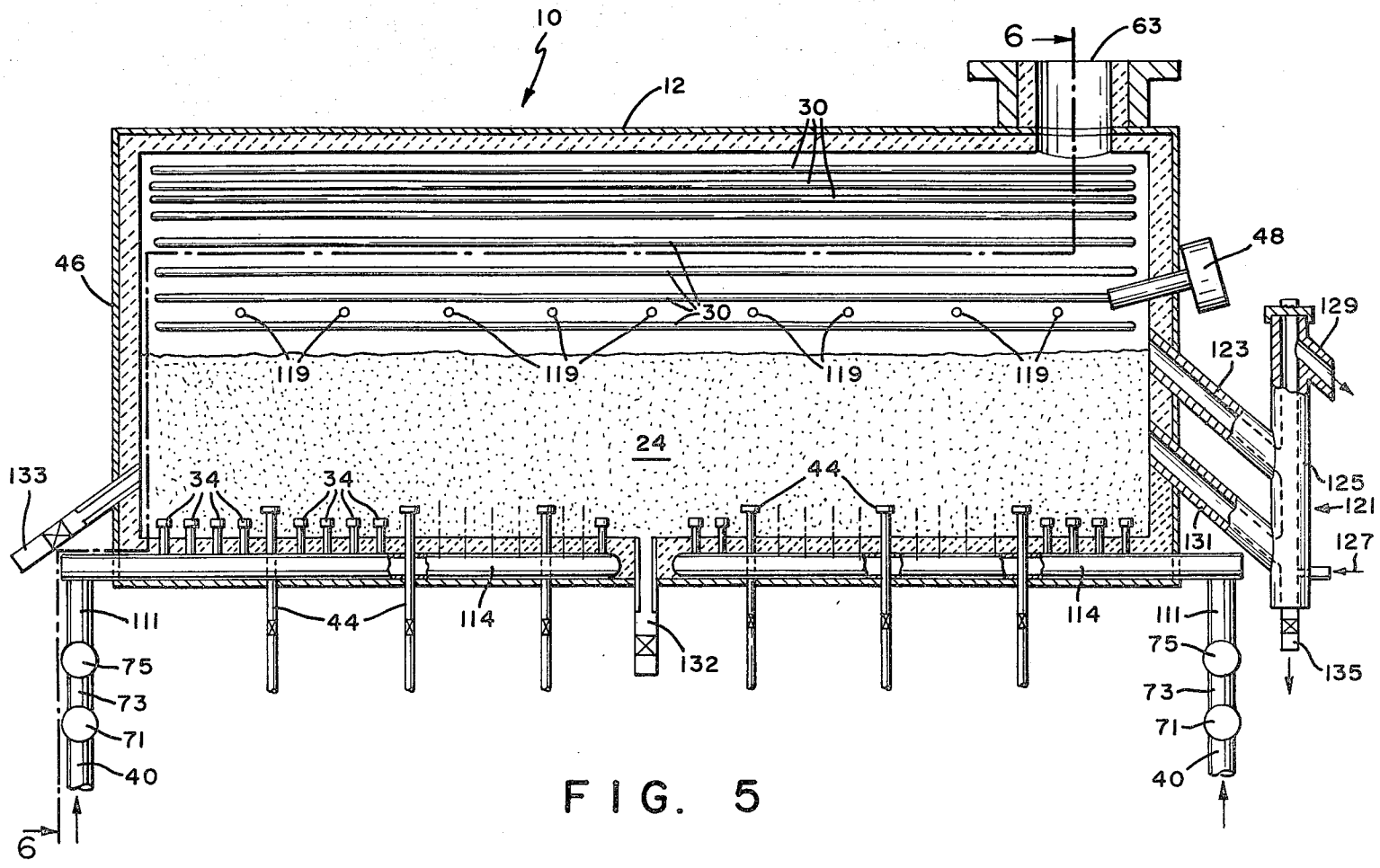
Figure 6:
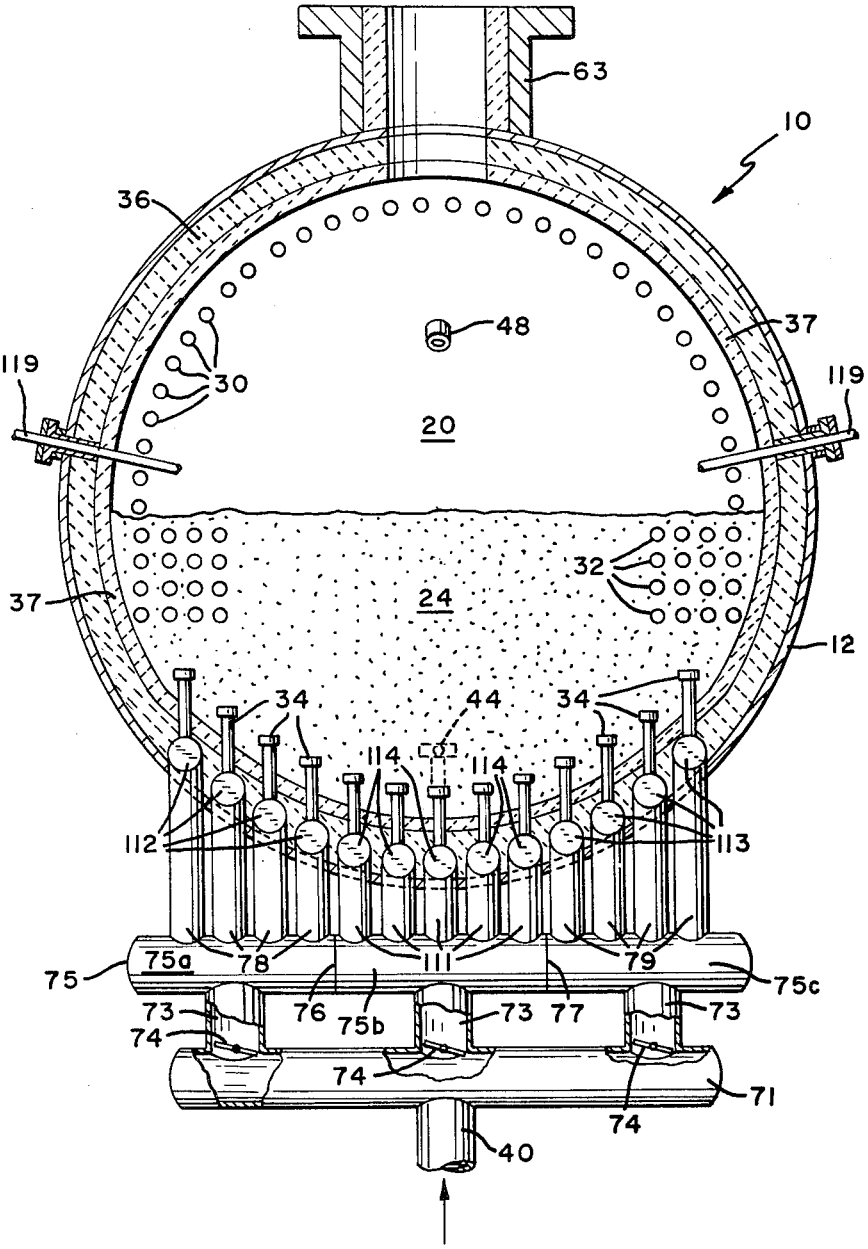

Other objects and advantages will become apparent from the following description taken in conjunction with the accompanying drawings in which:

FIG. 1 is a perspective view of the fluid bed heater or vaporizer unit of the invention having an exploded section showing the interior of the unit, FIG. 2 is a view in section of the fluid bed heater or vaporizer unit of the invention, taken generally along line 2—2 of FIG. 1, FIG. 2*a* is a fragmentary view showing a portion of the structure illustrated in FIG. 2 with an alternate fuel feed arrangement, FIG. 2*b* is a fragmentary view in section showing a portion of the structure illustrated in FIG. 2 with a further alternate fuel feed arrangement, FIG. 3 is a view in longitudinal section of the fluid bed heater or vaporizer unit of the invention taken generally along line 3—3 of FIG. 1, FIG. 4 is a flow diagram of the fluid bed heater or vaporizer unit of the invention with associated equipment, FIG. 5 is a view in longitudinal section of another embodiment of the fluid bed heater or vaporizer unit of the invention with a modified structure for admission of fluidizing air and without an internal economizer, and FIG. 6 is a view in section of the fluid bed heater or vaporizer unit of the invention, taken generally along line 6—6 of FIG. 5.

The fluid bed heater or vaporizer of this invention comprises an enclosed vessel having means for introducing an oxygen-containing gas into the lower portion thereof to fluidize a body of particulate solids forming a fluidized bed within said vessel, heat exchange tubes located within said vessel both in the freeboard above the level of the fluidized bed (convection/radiation tubes) and within the fluidized bed (in-bed tubes), means for regulating the supply of gas into said vessel to provide in the fluidized bed a combustion zone of high turbulence and low density, and at least one heat transfer zone of relatively low turbulence and high density, the combustion zone and the heat transfer zone being in free flow communication with each other and the in-bed heat exchange tubes being located in the heat transfer zone.

The means for introducing oxygen-containing gas into the vessel includes a gas supply conduit for conducting the gas to a point adjacent the vessel, a plurality of injection means within said vessel for introducing the gas into the fluidized bed region of the vessel; e.g., tuyeres, and gas-distribution structure connecting the gas supply conduit to the injection means. The gas distribution structure may be, for example, a constriction plate dividing the interior volume of the vessel into a reaction chamber above, and a windbox below, or an array of gas-distribution pipes within and/or outside the vessel.

Thus, in one embodiment of the invention, the fluid bed heater or vaporizer comprises a horizontally oriented cylindrical vessel having a constriction plate therein aligned parallel to the axis of the shell. The constriction plate defines a windbox below and a larger reaction chamber above. A bed of solid particulates is supported by the constriction plate for fluidization. The arched wall of the reaction chamber is lined with convection/radiation heat exchange tubes and the fluidized bed has a combustion zone and at least one heat transfer zone, the latter zone or zones being provided with in-bed heat exchange tubes. The in-bed heat exchange tubes are located within the expanded bed level of the fluidized bed, but above the slumped bed level of the bed. The velocity of the fluidizing gases in the heat transfer zone of the bed is lower than the fluidizing velocity in the combustion zone of the bed to reduce the erosion of the heat exchange tubes. The particulate matter in the fluidized bed is free to circulate between the combustion zone and the heat transfer zones of the bed, for there are no obstructing partitions between these zones. At one end of the bed a partition or weir is provided to define an ash cooling section and, in the freeboard space above the ash cooling section, an economizer is provided, comprising a plurality of heat exchange tubes in the freeboard for contact with the exhaust gases from the reaction chamber.

Air is introduced into the windbox, for example, through one or both end walls of the heater or vaporizer unit, while a feed of coal and limestone is supplied to the bed, preferably through the cylindrical wall of the reactor vessel. An oil starter burner may be provided in the end wall or cylindrical wall of the reactor vessel to initiate combustion within the reactor. An additional economizer section may be added, external to the reactor vessel, to extract additional heat from the exhaust gases. The weir separating the ash cooling section from the combustion regions of the fluidized bed regulates the discharge of ash into the ash cooler. A conduit is provided to discharge ashes from the ash cooling section of the reactor vessel for disposal external of the unit.

As described above, an important feature of the invention common to the various embodiments thereof is the provision in the fluidized bed of communicating zones of differing turbulence and density. These zones are established by controlling the amount of fluidizing air supplied to each; a larger volume of air per unit bed volume to the zone of high turbulence, and a smaller volume of air per unit bed volume to the zone of low turbulence. One method of accomplishing this, in the embodiment incorporating a windbox, is to supply air to an unpartitioned windbox and to install a smaller number of tuyeres per unit area below the zone of low turbulence than are provided below the zone of high turbulence. This approach permits use of a single size of tuyeres. Another method is to use the same number of tuyeres per unit area below both zones, but to employ tuyeres having smaller flow passages below the zone of low turbulence. Still another method involves partitioning the windbox so that the air flow to the zones are independent of each other. Separate compressors may then be employed to develop the desired turbulence in each zone of the fluidized bed. Of course, combinations of the above methods may be used and, certainly, use may be made of flow regulating valves in combination with the aforesaid methods to achieve the desired result.

Referring now to the drawings, in FIGS. 1 and 2 there is illustrated a fluid bed heater or vaporizer 10 of cylindrical configuration, the major axis of the cylinder being horizontally oriented. The unit comprises a vessel 12 which may be fabricated of carbon steel. The interior of the vessel is provided with a perforated constriction plate 18 which separates the interior volume of the reactor vessel into two compartments of unequal size; a windbox 22 below the constriction plate 18 and a reaction chamber 20 above the constriction plate. Feed solids are introduced through feed conduits 42. A body of particulate solids 24 is supported on the constriction plate 18 and a plurality of convection/radiation heat exchange tubes 30 line the arched wall of the reaction chamber 20 above the level 23 of the expanded fluidized bed and extend longitudinally of the vessel 12 generally parallel with the axis thereof. Within the expanded bed level 23 of the fluidized bed 24 a number of in-bed tubes 32 are provided, but these in-bed tubes are located above the slumped bed level 25. The in-bed tubes 32 extend longitudinally of the cylindrical vessel 12, are held in alignment by tube supports 31 and are located in a heat transfer zone or zones 28 of bed 24 of lesser turbulence than that prevailing in the combustion zone 26 of the bed, which is free of heat exchange tubing. One purpose in locating the in-bed tubes 32 in this fashion is to reduce the erosion of the tubes and this zone of reduced turbulence may be established, as previously indicated, by providing a lesser number of tuyeres 34 below the zones 28 in which the in-bed tubes 32 are located. Since relatively high temperatures are developed in the reaction chamber 20, it is preferred to insulate the metal vessel 12 and constriction plate 18 by providing a layer of refractory material, such as a castable ceramic. In FIG. 2, such a refractory layer 36 is shown positioned between the vessel 12 and the convection/radiation tubes 30, while a similar layer of refractory material 38 is shown in place on the constriction plate 18. A plurality of tuyeres 34 pass through constriction plate 18 and refractory 38 to provide communication between the windbox 22 and the reaction chamber 20.

In the end wall 46 of the heater or vaporizer unit 10 there is provided an oil-fired start-up burner 48 which is directed through the end wall 46 so that the flame thereof impinges on the fluidized particulate material in bed 24 to ignite the fuel and raise the temperature of the fluidized bed to a point at which combustion of the bed materials is self-sustaining. An air duct 40 is also provided in end wall 66, as shown in FIG. 1, for supplying fluidizing and combustion air to windbox 22. Alternatively, however, combustion and fluidizing air may be supplied to windbox 22 through vessel 12 of unit 10 by one or more conduits 41 (dotted line showing) at or near the bottom of unit 10.

At the opposite end of the heater or vaporizer unit 10 an economizer 60 is provided. The economizer 60 is positioned in the freeboard of the reaction chamber 20 and comprises heat exchange tubes 56 located in the gas exhaust stream of unit 10. Below economizer 60 is the ash cooler section 50 of the fluidized bed 24. Ash cooler section 50 is separated from fluidized bed 24 proper by a weir 52. The ash discharge conduit 68 communicates with ash cooler section 50 in an overflow arrangement. A relatively low fluidizing velocity for the air is employed in the ash cooler section 50 to minimize elutriation of ash solids. This low fluidizing velocity may be obtained, again, by providing an appropriate number of tuyeres.

While an economizer 60 has been provided within the vessel 12 as just described, it may be necessary or advisable to add another economizer in the exhaust gas stream and such an auxiliary economizer unit 14 is shown fixed to the end of the heater or vaporizer unit 10. Within the auxiliary economizer unit 14 a plurality of heat exchange tubes 62 are positioned in the exhaust gas stream for heat exchange therewith. A cyclone inlet conduit 64 is provided for discharge of the exhaust gases from economizer 14.

It is believed that the operation of the fluid bed heater or vaporizer unit 10 can be readily understood from the above description and the drawings, however, operation of the unit will be briefly described. In start-up, a quantity of combustible particulate solids, such as coal and limestone are introduced into reaction chamber 20 through the feed conduits 42. Air is then introduced into the windbox through conduit 40 and traverses the tuyeres 34 in the constriction plate 18 to fluidize the solids in bed 24. The start-up burner 48, which is supplied with both oil and air, is ignited and the flame impinges on the fluidized bed and rapidly heats the bed to ignition temperature. By reason of the excellent circulation which characterizes such fluidized beds, the ignition temperature is attained uniformly throughout the bed. When combustion is established in the fluidized bed, the start-up burner 48 is extinguished and, from that point on, the combustion in the bed is self-sustaining as long as sufficient fuel solids are introduced through feed conduits 42 and so long as sufficient air is introduced through conduit 40 to maintain the fluidized bed in its fluidized state and to support combustion.

The combustion occurs primarily in the bed 24 to which a mixture of coal and limestone has been provided, and the temperature within the bed is quite uniform in every part thereof. To some extent, however, combustion of gases will occur in the freeboard above bed 24. It will be observed that the central section of the constriction plate 18 in the embodiment shown in FIG. 2 contains a relatively large number of tuyeres 34 so that a large volume of fluidizing air is introduced into the central region or combustion zone 26 of the fluidized bed 24. In contrast, a lesser number of tuyeres 34 is provided at the side regions or heat transfer zones 28 of the fluidized bed 24 so that a region of generally lower velocity gases and decreased turbulence prevails in the heat transfer zones 28. Since the combustion zone 26 of fluidized bed 24 has a large volume of air therein, the density of this region will be less than that of the heat transfer zones 28 and so a circulation will occur as indicated by the arrows in FIG. 2, with the denser material from the heat transfer zones 28 flowing inward to the central region of the fluidized bed 24 along the constriction plate 18, while lighter materials in the combustion zone 26 will tend to flow upward and outward into the heat transfer zones 28 along or adjacent to the surface of the fluidized bed. Since the heat transfer zones 28 are regions of lesser turbulence, erosion of in-bed tubes 32 will be within tolerable limits and extended life of the heat exchange tubes can be expected.

At this point another feature of the in-bed tubes 32 should be noted. These tubes are positioned at a level which is within the expanded fluidized bed region; i.e., the region occupied by the bed when it is fully fluidized by the air introduced into the reaction chamber through the tuyeres 34 in the constriction plate, the top surface 23 being the upper extremity of the fully expanded bed. However, these tubes 32 are above the level of the slumped bed; i.e., the bed level which the bed assumes when the flow of fluidizing air is terminated (the upper level of the slumped bed being indicated by the dotted line 25 in FIG. 2). Thus, when the flow of fluidizing air is interrupted for any reason the in-bed tubes 32 will not be subject to excessively high temperatures as might occur if these tubes were immersed in a dense, quiescent, slumped bed during a shut-down when local overheating is likely. In this way, high temperature corrosion is minimized.

In FIG. 2*b* there is a showing of partitions 21 in the windbox 22. These partitions may be optionally provided to permit closer control of the fluidizing conditions in bed 24. For example, in start-up, there is no real need to fluidize the entire bed 24 and the central portion alone may be fluidized until combustion is established in the bed. Further, these windbox partitions 24 may be utilized to accommodate output of the unit to conditions where less than full output is required. The amount of fluidizing air supplied to the heat transfer zones 28 may be adjusted from zero upwards to provide fractional outputs.

As indicated previously, the in-bed heat exchange tubes 32 are located in regions of the fluidized bed 24 where conditions of relatively low turbulence prevail. In FIG. 2, one advantageous embodiment of this concept, the central high turbulence zone 26 is trough-like in configuration (see dotted line showing in bed 24) gradually widening as the air expands in rising to the surface of bed 24. This upward widening of the high turbulence combustion zone 26 is taken into consideration in locating in-bed heat exchange tubes 32 to assure that tubes 32 are located in the low turbulence regions; heat transfer zones 28.

The combustion gases which rise from the fluidized bed then flow generally horizontally through the freeboard region in reaction chamber 20 exposing the convection/radiation tubes 30 to heating throughout their entire length.

There is a general flow of solids in the fluidized bed from the vicinity of end wall 46 toward the weir 52 near the opposite end of the unit 10. Of course, as the solids approach the weir 52 they have been subjected to combustion temperatures for a substantial length of time and the proportion of ash in the solids adjacent the weir 52 is high. The solids in the ash cooling chamber 50 are at elevated temperature and fluidizing air, at relatively low velocity, is supplied to the ash cooling chamber to provide the necessary cooling. This fluidizing air, in traversing the ash cooling chamber 50 is heated to a relatively high temperature and passes with the combustion gases through the economizer 60 of the unit 10 effecting a heat exchange with the heat transfer tubes 56 located therein. The ash in ash cooling chamber 50, passes into the ash discharge conduit 68 leading to the ash bin 72. As indicated previously, an auxiliary economizer 14 may be provided to receive the exhaust gases from the primary economizer through passageway 58. The exhaust gases from passageway 58 traverse the auxiliary economizer heat exchange tubes 48 before exhausting from economizer 14 through cyclone inlet 64.

The flow of heat exchange fluid in the various heat exchange tubes will be as follows: The fluid will be introduced first into the heat exchange tubes 62 of the auxiliary economizer 14. From economizer 14 the fluid will be conducted through heat exchange tubes 56 of the economizer 60 and from the heat exchange tubes 56 will be passed to the convection/radiation tubes 30 and then to the in-bed tubes 32 of the unit 10. In this way the fluid in the heat exchange tubes is heated in several stages to maximum temperature.

In FIG. 4, the fluid bed heater or vaporizer unit 10 of the present invention is shown with auxiliary equipment in a flow diagram for a steam flooding application. The materials supplied to the steam boiler 10' are fuel oil, air, coal, limestone and water. Oil is pumped from the oil tank 80 by the oil pump 82 through line 84 to the oil burner 48, which, as previously described, directs a flame upon the fluidized bed in boiler 10 to initiate combustion therein. The air compressor 100 supplies air to the unit 10' through line 40. The air fluidizes the bed within unit 10' and supports combustion. The combustion gases are exhausted through the economizer 14, the cyclone inlet 64 and cyclone 66, which separates out a large proportion of the entrained solids. From cyclone 66 the gases are forwarded through line 70 to the baghouse 104 where finer solids are separated and disposed of through line 108 while the gases are exhausted to stack 106. A coal hopper 86 and limestone hopper 90 are provided supplying coal feed bin 88 and limestone feed bin 92, respectively. Bins 88 and 92 feed the fluidized bed within the unit 10' through the feedlines 42. Combustion within unit 10' produces ash in the fluidized bed which is discharged through ash discharge line 68 to the ash bin 72 for disposal. A pump 94 supplies water to water conduit 96 which supplies the various heat exchange tubes in the system. In this case, line 96 is shown supplying the heat exchange tubes within economizer 14 and, as explained previously, water is passed from the economizer 14 into the heat exchange tubes within unit 10' proper where it is vaporized and then discharged as steam through line 98 for use in the steam flooding process.

Turning to the embodiment illustrated in FIGS. 5 and 6, it will be noted that a somewhat different fluidizing air supply has been utilized. Thus the air conduit 40 supplies air to the main header 71 from which air is routed to the fluidizing air supply header 75 through damper conduits 73. The flow of air through damper conduits 73 is controlled by an air damper 74 positioned in each conduit 73. The fluidizing air supply header 75 is divided by wall members 76 and 77 into the header compartments 75*a*, 75*b* and 75*c*, each of which is supplied by one of the damper conduits 73. The header compartment 75*a* serves a plurality of air pipes 78 while header compartment 75*b* serves the air pipes 111 and compartment 75*c* is connected to the air pipes 79. The air headers 112, 113 and 114 which extend longitudinally of the reactor vessel are imbedded in a layer of low density insulating castable refractory 36 between the inside of vessel wall 12 and the dense layer of castable refractory 37, the latter of which is the innermost wall component. A plurality of tuyeres 34 are positioned along the length of air headers 112, 113 and 114 extending through the refractory layers 36 and 37 to connect with the air headers so as to deliver oxygen-containing gas into the reactor chamber for fluidizing the particulate solids within the chamber 20, thereby forming the fluidized bed 24. This arrangement of headers provides three groups of tuyeres wherein the air supply to each group is controlled by the air dampers 74. With this arrangement then, it is relatively easy to establish a region of high turbulence in the fluidized bed 24 by permitting relatively large amounts of fluidizing gas to flow through the header compartment 75*b* and at the same time provide regions of relatively low turbulence by permitting only lesser amounts of air to flow through header compartments 75*a* and 75*c*. The air headers 114 extend through the end walls 46 of the unit 10 into the layer of castable refractory 36. The arrangement shown in FIG. 5 illustrates an adaptation suitable for use where the unit is rather long, say 40' or more in length, and, as a result, the air supply to the tuyeres 34 along the length of the air headers would tend to be non-uniform. In such a case, as FIG. 5 shows, independent air headers 114 may be provided entering at opposite ends of the unit 10 each with its own air conduit 40 and intermediate header air supply arrangement.

It will be noted that the unit illustrated in FIGS. 5 and 6 does not have an internal economizer unit, but instead, the flue gas stack 63 may be connected to an external economizer unit.

The unit illustrated in FIGS. 5 and 6 also incorporates a plurality of overbed air jets 119 which may serve a dual function. On start-up, or where the unit is to be operated below its full capacity, certain of the tuyeres 34 may not be introducing air into the reactor. Over those tuyeres not in use, the particulate solids are not fluidized and material from the fluidized regions tends to blow over, accumulate and build up. If such build up is not controlled, fluidization of such heavy accumulations of material are likely to be difficult to fluidize when fluidization becomes desirable. The air jets 119 can be utilized to prevent the undesirable accumulation of unfluidized particulate solids; they function simply by blowing unfluidized particulate solids back into the fluidized portion of the bed. These air jets may also be utilized as over-bed air nozzles to introduce air for improved combustion and also to permit staged combustion for low emissions of oxides of nitrogen.

The embodiment of FIGS. 5 and 6 does not include internal ash cooling structure and this function is carried out by means (not shown) external to unit 10. The ash removal arrangement for the embodiment of FIGS. 5 and 6 comprises an inclined ash withdrawal pipe 123 which passes through the wall of unit 10 and is open at its upper end at the top surface of fluidized bed 24. Ash withdrawal pipe 123 joins a vertical pipe section 125 at its lower end. The vertical pipe 125 is joined by a second inclined pipe 129 at a point well above the juncture of pipes 123 and 125. The ash withdrawal system operates on the fluidized solids principal and ash particles which flow from the fluidized bed 24 into the downwardly inclined ash withdrawal pipe 123 are fluidized upon reaching pipe 125 by air admitted through injection nozzle 127. The ash particles are lifted by the fluidizing air to the level at which pipe 129 joins 125. The fluidized ash particles flow into pipe 129 and, under the influence of gravity, flow down pipe 129 into a suitable bin or other container for disposal. The inclined pipe 131, upon opening valve 135, is used to withdraw excess bed material from fluidized bed 24, thereby regulating the bed level.

Provision is made in the embodiment of FIGS. 5 and 6 for rapid dumping of the fluidized bed when that becomes necessary. Thus, bed dumping conduits 132 and 133 are provided.

The invention has been described primarily in connection with the use of coal as a fuel. It will be understood that a fluid bed combustion unit is quite flexible in the matter of the type of fuel it can consume. Thus, coke, petroleum coke, wood chips and combustible waste materials may be utilized alone or in combination as fuels. It is also contemplated that a combustion unit operating on solid fuels might use oil as a supplemental fuel, or, should the supply of solid fuel fail for one reason or another, the unit might operate for a time on an oil feed alone. Where oil is to be employed as a fuel, appropriate feed guns would, of course, have to be provided.

Solid fuel feed has been described as being introduced through feed lines 42 which pass through the top of unit 10, but it may optionally be introduced through feedline 43 (See FIG. 2*a*) which passes through cylindrical wall 12 just above the constriction plate 18 and then into fluidized bed 24 or through feedlines 44 (See FIGS. 2*b* and 5) which pass through the bottom of cylindrical wall 12 and then vertically (through constriction plate 18 in the case of the embodiment of FIG. 2*b*) into fluidized bed 24.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A fluid bed heater or vaporizer comprising an enclosed vessel having means for introducing an oxygen-containing gas into the lower portion of said vessel to fluidize a body of particulate solids forming a fluidized bed within said vessel, heat exchange tubes within said vessel including convection/radiation heat exchange tubes in the freeboard above said fluidized bed and in-bed heat exchange tubes within said fluidized bed, means for regulating the supply of gas into said vessel to provide in the fluidized bed a combustion zone of high turbulence and low density and at least one heat transfer zone of relatively low turbulence and high density, said combustion zone and said heat transfer zone being in free-flow communication with each other and said in-bed heat exchange tubes being located in said heat transfer zone.

2. The fluid bed heater or vaporizer of claim 1 wherein said in-bed heat exchange tubes are positioned within the expanded bed level of said fluidized body, but above the slumped bed level thereof.

3. The fluid bed heater of vaporizer of claim 2 wherein said vessel is in the form of a horizontally oriented cylinder and said convection/radiation heat exchange tubes in said vessel are arranged in an arched configuration conforming generally to the wall of said cylindrical vessel and in contact therewith.

4. A fluid bed heater or vaporizer in accordance with claim 3 wherein said convection/radiation heat exchange tubes are oriented generally parallel to the horizontal axis of said cylindrical vessel.

5. The fluid bed heater or vaporizer of claim 4 wherein said in-bed heat exchange tubes are oriented generally parallel to the horizontal axis of said cylindrical vessel.

6. The fluid bed heater or vaporizer of claim 5 wherein an ignition means is provided in the end wall or curved wall of said cylindrical vessel positioned to direct a flame upon said fluidized bed within said vessel.

7. A fluid bed heater or vaporizer in accordance with claim 1 wherein said means for introducing an oxygen-containing gas into the lower portion of said vessel comprises a constriction plate dividing the interior volume of said vessel into a reaction chamber thereabove and a windbox therebelow, the constriction plate being capable of supporting a fluidized bed of particulate solids thereon.

8. The fluid bed heater or vaporizer of claim 7 wherein ignition means is provided for initiating combustion of said particulate solids, conduit means are provided for introducing a fluid flow into said heat exchange tubes, said convection/radiation heat exchange tubes being in flow communication with said in-bed tubes, treating and transporting means for separating, cooling and conducting away from said heater or vaporizer the particulate solids remaining after combustion in the reaction chamber, exhaust gas conduit means for exhausting combustion gases from said heater or vaporizer and conduit means for conducting the heated or vaporized fluid from said heat exchange tubes of said fluidized bed heater or vaporizer to the point of application.

9. The fluid bed heater or vaporizer of claim 8 wherein said in-bed heat exchange tubes are located within the expanded bed level of said fluidized body, but above the slumped bed level thereof.

10. The fluid bed heater or vaporizer of claim 9 wherein said treating and transporting means comprises a weir in said reaction chamber extending from said constriction plate upward to thereby determine fluidized bed height, said weir separating said fluidized bed into a larger reactive bed and a smaller ash cooling bed, the fluidizing gas traversing said ash cooling bed to extract heat from said ash and ash conduit means for removing ash from said ash cooling bed to a point exterior of said fluid bed heater or vaporizer.

11. The fluid bed heater or vaporizer of claim 10 wherein economizer heat exchange tubes are provided in said exhaust gas conduit means for extracting heat from said exhaust combustion gases.

12. The fluid bed heater or vaporizer of claim 11 wherein said vessel is in the form of a horizontally oriented cylinder and said constriction plate therein lies generally parallel to the horizontal axis of said vessel.

13. A fluid bed heater or vaporizer in accordance with claim 12 wherein said convection/radiation heat exchange tubes in said reaction chamber are arranged in an arched configuration conforming generally to the side wall of said cylindrical vessel and in contact therewith.

14. A fluid bed heater or vaporizer in accordance with claim 13 wherein said convection/radiation heat exchange tubes are oriented generally parallel to the horizontal axis of said cylindrical vessel.

15. The fluid bed heater or vaporizer of claim 14 wherein said in-bed heat exchange tubes are oriented generally parallel to the horizontal axis of said cylindrical vessel.

16. The fluid bed heater or vaporizer of claim 15 wherein said ignition means is an oil starter burner in the end wall or said side wall of said cylindrical vessel positioned to direct a flame upon said fluidized bed within said reaction chamber and wherein said exhaust gas conduit means is located in said end wall.

17. The fluid bed heater or vaporizer in accordance with claim 16 wherein said means for introducing particulate solids feed into said reaction chamber includes one or more conduits penetrating said side wall of said fluid bed heater or vaporizer.

18. A fluid bed heater or vaporizer comprising a horizontally oriented cylindrical vessel having a constriction plate therein lying generally parallel to the axis of said vessel, said constriction plate being secured to said vessel and dividing the interior volume of said vessel into an elongated reaction chamber thereabove and a windbox of similar shape therebelow, said constriction plate adopted to support a fluidized body of particulate solids undergoing an exothermic reaction, a plurality of convection/radiation heat exchange tubes in said reaction chamber located above the expanded bed level in the freeboard volume of said reaction chamber arranged in an arched configuration conforming generally to the side wall of said vessel, a plurality of in-bed heat exchange tubes located within the expanded bed level but above the slumped bed level of said fluidized body, means for introducing fluidizing air into said windbox, means for introducing solid porticalate feed into said reaction chamber and said bed, means for regulating the flow of fluidizing air through said constriction plate to provide in said bed a combustion zone having a relatively high turbulence and at least one heat transfer zone having a relatively low turbulence, a weir in said reaction chamber extending from said constriction plate upward to just short of said primary heat exchange tubes to determine fluidized bed height, said weir separating said fluidized bed into a larger reactive bed and a smaller ash cooling bed, means for removing ash from said ash cooling bed, economizer tubes in the freeboard space above said ash cooling bed to extract heat from the combustion gases exiting the reaction chamber, conduit means communicating with the freeboard space above said ash cooling bed for removal of exhaust gas from said reaction chamber.

19. The fluid bed heater or vaporizer of claim 1 wherein said means for introducing an oxygen-containing gas into the lower portion of said vessel comprises a plurality of gas injection means within said vessel for introducing gas into the fluidized bed region of said vessel and an array of gas distribution pipes connecting said injection means with a gas supply conduit.

20. The fluid bed heater or vaporizer of claim 19 wherein at least a portion of said array of gas distribution pipes is imbedded within a refractory layer which is a component of the wall of said vessel.

21. The fluid bed heater or vaporizer of claim 20 wherein said gas injection means are tuyeres and a plurality of gas dampers are provided in said array to control the flow of gas to said tuyeres.

22. A fluid bed heater or vaporizer comprising a horizontally oriented cylindrical vessel having a constriction plate therein lying generally parallel to the main axis of said vessel, said constriction plate being secured to said vessel and dividing the interior volume of said vessel into an elongated reaction chamber thereabove and a windbox of similar shape therebelow, said constriction plate adopted to support an elongated fluidized body of particulate solids undergoing an exothermic reaction, a plurality of convection/radiation heat exchange tubes in said reaction chamber located above the expanded bed level in the freeboard volume of said reaction chamber arranged in an arched configuration conforming generally to the side wall of said vessel, a plurality of in-bed heat exchange tubes located within the expanded bed level but above the slumped bed level of said fluidized body, said convection/radiation and in-bed heat exchange tubes conducting a working fluid into and through said vessel, means for introducing fluidizing air into said windbox, means for introducing solid particulate feed into said reaction chamber and said bed, means for regulating the flow of fluidizing air through said constriction plate to provide in said bed a combustion zone having a relatively high turbulence and at least one heat transfer zone having a relatively low turbulence, said combustion zone and said heat transfer zone or zones being in free-flow communication with each other and lying parallel to each other and to said major axis of said vessel, said in-bed heat exchange tubes being located only in said heat transfer zone or zones and lying parallel to said major axis of said vessel so that hot particulate solids circulating from said combustion zone to said heat transfer zone or zones move essentially in directions perpendicular to said working fluid flowing in said in-bed heat exchange tubes and conduit means for removal of exhaust gas from said reaction chamber.

* * * * *